US009418797B2

(12) United States Patent
Nishida et al.

(10) Patent No.: US 9,418,797 B2
(45) Date of Patent: Aug. 16, 2016

(54) ELECTROMAGNETIC SWITCH

(71) Applicant: DENSO CORPORATION, Kariya, Aichi-pref. (JP)

(72) Inventors: Ryo Nishida, Nagoya (JP); Akifumi Hosoya, Anjo (JP); Masao Saito, Okazaki (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/821,146

(22) Filed: Aug. 7, 2015

(65) Prior Publication Data

US 2016/0042881 A1 Feb. 11, 2016

(30) Foreign Application Priority Data

Aug. 7, 2014 (JP) ..... 2014-161016

(51) Int. Cl.
*H01H 51/22* (2006.01)
*H01H 1/06* (2006.01)
*H01H 50/54* (2006.01)

(52) U.S. Cl.
CPC ..... *H01H 1/06* (2013.01); *H01H 50/54* (2013.01); *H01H 2203/036* (2013.01)

(58) Field of Classification Search
CPC ..... H01H 50/54–50/546
USPC ..... 335/83, 126, 131
See application file for complete search history.

(56) References Cited

U.S. PATENT DOCUMENTS 2,853,578 A * 9/1958 Rommel ..... H01H 1/26 200/280
3,260,824 A * 7/1966 Schleicher ..... H01H 1/2083 200/243
4,540,963 A * 9/1985 Esterl ..... H01H 1/18 335/133
4,665,375 A * 5/1987 Weiser ..... H01H 50/548 335/128
4,956,624 A * 9/1990 Streich ..... H01H 50/545 335/132
5,548,260 A * 8/1996 Kogure ..... H01H 1/06 335/126
5,679,935 A * 10/1997 Baba ..... H01H 50/20 200/17 R
6,362,710 B2 * 3/2002 Oberndorfer ..... 200/238
7,843,289 B1 * 11/2010 Raklyar ..... H01H 1/06 200/16 R
7,982,564 B2 * 7/2011 Farrar ..... H01H 50/14 335/126
8,786,388 B2 * 7/2014 Ramezanian ..... H01H 1/06 335/126

FOREIGN PATENT DOCUMENTS

JP S54-88563 U 6/1979
JP 2013-062156 A 4/2013

* cited by examiner

*Primary Examiner* — Alexander Talpalatski
(74) *Attorney, Agent, or Firm* — Oliff PLC

(57) ABSTRACT

Two protrusions are disposed on the fixed contact along a lateral direction on a contacting surface. The two protrusions are disposed in a longitudinal direction with a predetermined interval on the contacting surface, and a planar portion is formed between the two protrusions. A single projection that intersects perpendicular to the two protrusions disposed on a first fixed contact and another single projection that intersects perpendicular to the two protrusions disposed on a second fixed contact are disposed on a movable contact. Thereby, when the movable contact contacts to a pair of fixed contacts, since the protrusions disposed on the fixed contact and the projections disposed on the movable contact contacts only at intersections of each other, a contacting surface pressure is increased and a crushing force for ice frozen on a surface of the fixed contact becomes large.

3 Claims, 7 Drawing Sheets

(II—II)

(II—II)

(IVb－IVb)

(IVc－IVc)

CONVENTIONAL TECHNOLOGY

ELECTROMAGNETIC SWITCH

CROSS-REFERENCE TO RELATED APPLICATION

This application is based on and claims the benefit of priority from earlier Japanese Patent Application No. 2014-161016 filed Aug. 7, 2014, the description of which is incorporated herein by reference.

TECHNICAL FIELD

The present disclosure relates to an electromagnetic switch for opening and closing electrical contacts in response to respective ON/OFF operation of a solenoid, and especially, is preferably used in an electromagnetic switch mounted on a starter.

BACKGROUND

When using a starter in cold climates, for example, a surface of a fixed contact provided on an electromagnetic switch might freeze.

To be specific, when a power supply terminal of the electromagnetic switch is cooled through a battery cable, a surface temperature of the fixed contact fixed to the power supply terminal is lowered so that water vapor in the air is condensed on a contacting surface and freezes.

When the electromagnetic switch is operated under this condition, since an ice layer is formed on the surface of the fixed contact that is the contacting surface of the movable contact, a problem of causing a conductive failure between the contacts may occur.

In contrast, as shown in FIG. 8A, forming a plurality of grooves 110 on a surface of a fixed contact 100 as a conventional technology is disclosed in the Japanese Utility Model Publication No. 54-88563.

According to this conventional technology, since a contacting area when the contact is abutting is reduced and a contact pressure per unit area is increased, it becomes possible to crush the ice layer formed on the surface of the fixed contact 100 by an impact force when the contact is abutting.

However, in the conventional technology mentioned above (Publication No. '563), since flat surfaces 120 are left between a number of grooves 110 formed on a surface of the fixed contact 100, that is, between the adjoining grooves 110, as shown in FIG. 8B, it is not possible to sufficiently increase the contacting pressure between the contacts.

For this reason, in the electromagnetic switch that is used in severe cold environmental conditions or has a structure difficult to discharge humidity, there is a possibility that ice-crushing force is insufficient.

In this case, the ON/OFF operation needs to be repeated for several tens of times in order to secure the conduction by crushing the ice on the contacting surface.

Further, even if the ice could be crushed, a process of eliminating the crushed ice from the contacting surface is required in order to secure the conduction between the contacts.

However, in the conventional technology, since a large number of grooves 110 are formed on the contacting surface, a surface area where the ice adheres increases compared with a flat contacting surface where no grooves 110 are formed, thus there is a possibility that the crushed ice is likely to remain within the grooves 110.

In other words, it is difficult to eliminate the crushed ice from the contacts.

SUMMARY

An embodiment provides an electromagnetic switch that has a large crushing force for an ice frozen on a surface of a fixed contact, and can easily eliminate the crushed ice from the contacts An electromagnetic switch according to a first aspect includes a solenoid that forms an electromagnet by energization to a coil, a pair of fixed contacts respectively connected to a power supply side and a load side of an electrical circuit via two connecting terminals, and a movable contact that conducts and cuts off between the pair of fixed contacts in response to respective ON/OFF operation of the solenoid.

The pair of fixed contacts has a first fixed contact disposed in one side in a radial direction that intersects perpendicular to an axial direction of the solenoid and a second fixed contact disposed in another side in the radial direction.

When a direction which intersects perpendicular to the radial direction on a plane of the fixed contact is referred to as a longitudinal direction and another direction which intersects perpendicular to the longitudinal direction is referred to as a lateral direction, the fixed contact has two protrusions extending in the lateral direction on a contacting surface that faces the movable contact.

The two protrusions are disposed in the longitudinal direction with a predetermined interval therebetween, and a planar portion recessed relative to apexes of the protrusions is formed between the two protrusions.

The movable contact has a first contacting surface facing the first fixed contact and a second contacting surface facing the second fixed contact.

A single projection that intersects perpendicular to the two protrusions disposed on the first fixed contact is disposed on the first contacting surface, and another single projection that intersects perpendicular to the two protrusions disposed on the second fixed contact is disposed on the second contacting surface.

According to the above configuration, when the movable contact abuts the pair of fixed contacts by the ON operation of the solenoid, the projections disposed on the movable contact and the protrusions disposed on the fixed contacts come to contact with each other at intersections.

That is, the first fixed contact and the second fixed contact are contacted at two positions with respect to the movable contact, respectively.

In this case, since a contacting area between the movable contact and the fixed contact is decreased and a contacting surface pressure is increased as compared with the conventional technology disclosed in Publication No. '563, a crushing force for the ice frozen on a surface of the contact becomes large.

Moreover, since the planar portion is formed between the two protrusions disposed on the fixed contact, it is possible to collect the water that has condensed on the contacting surface of the planar portion, and even if the water freezes, the apexes of the protrusions can be prevented from freezing.

In other words, as long as the apexes of the protrusions are exposed from the surface of the ice frozen on the plane portion, it is possible to secure the conduction during the point of contact is abutting.

Furthermore, by forming the planar portion between the two protrusions, the surface area where ice adheres can be reduced as compared to the configuration that forms a plurality of grooves on the contacting surface disclosed in Japanese Utility Model Publication No. 54-88563.

Thereby, since it is possible to reduce the force with which the ice adheres on the surface of the fixed contact, it becomes easy to eliminate crushed ice from the contacts.

DETAILED DESCRIPTION OF THE PREFERRED EMBODIMENTS

Embodiments according to the present disclosure will be described with reference to drawings.

First Embodiment

In the first embodiment, an example where an electromagnetic switch 1 according to the present disclosure is mounted on a starter for starting an engine will be described.

Since configurations and functions of the starter are well known, detailed descriptions thereof are omitted, and a structure of the electromagnetic switch 1 according to the present disclosure will be described hereinafter.

The electromagnetic switch 1 includes a main point of contact (described below) for turning ON/OFF an electric current to a starter motor (not shown), and a solenoid SL for opening and closing the main point of contact.

Figure 5:
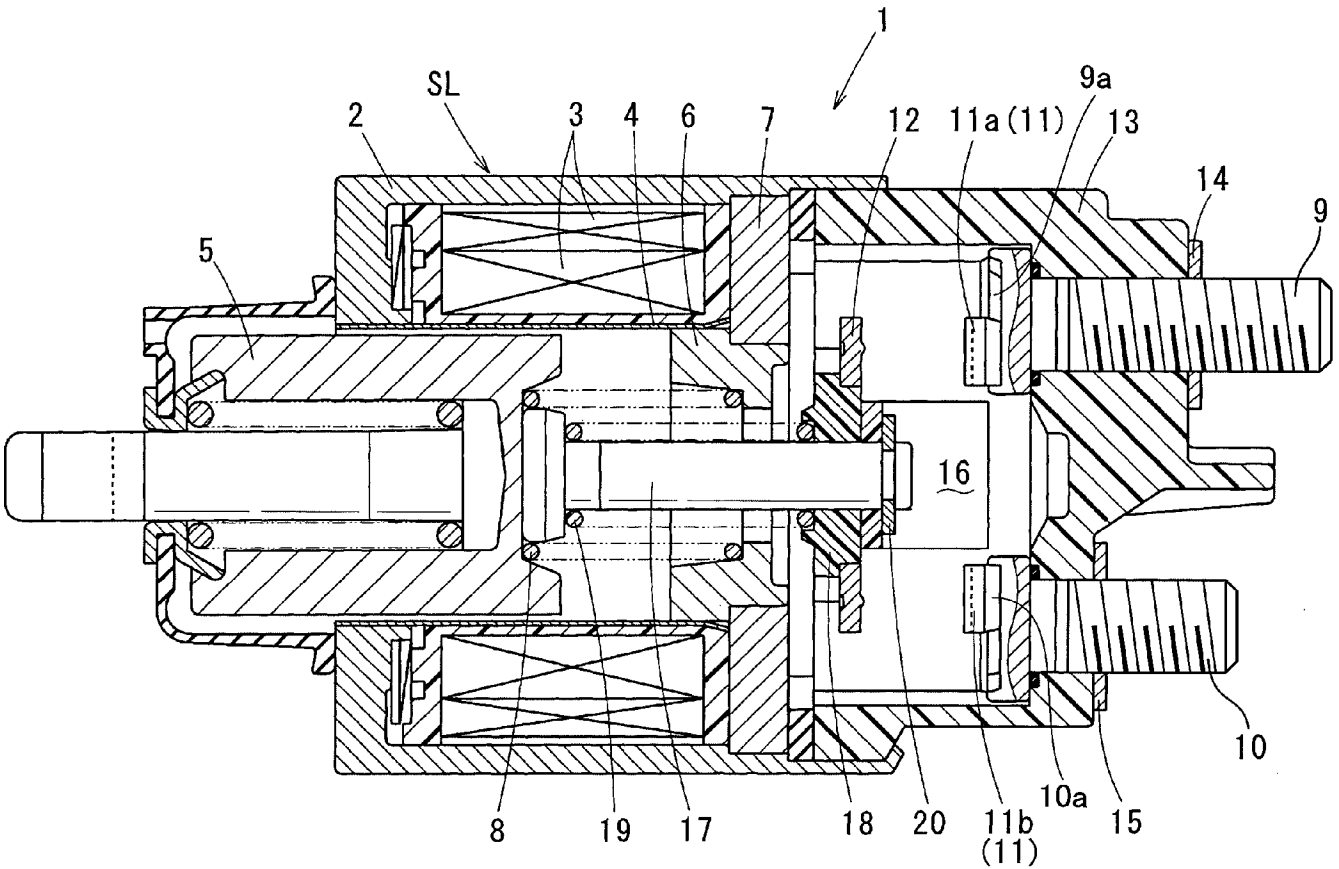
FIG. 5 shows a sectional view of an electromagnetic switch according to the first embodiment.

As shown in FIG. 5, the solenoid SL is composed of a metal frame 2 that also serves as a part of a magnetic circuit, a coil 3 accommodated inside the frame 2, a plunger disposed in an inner periphery of the coil 3 via a cylindrical sleeve 4, a fixed iron core 6 disposed facing to the plunger 5 in an axial direction, and etc.

One end of the coil 3 is connected to a connector terminal (not shown, also referred to as a 50 terminal) and another end of the coil 3 is connected to the ground side through the frame 2.

The connector terminal is connected to a battery via a starter switch or starter relay, for example.

The plunger 5 is inserted axially slidable in an inner periphery of the cylindrical sleeve 4, and is attracted to the magnetized fixed iron core 6 when an electromagnet is formed by energization to the coil 3.

The fixed iron core 6 is disposed in one axial end (shown right in FIG. 5) of the inner periphery of the cylindrical sleeve 4, and configured integrally with an annular shaped stationary core 7 by being press-fitted into an inner periphery of the stationary core 7.

The stationary core 7 connects between the frame 2 and the fixed iron core 6 magnetically.

A return spring 8 that pushes back the plunger 5 to a direction opposite to the fixed core (to the left in FIG. 5) when the attraction force of the electromagnet disappears is provided between the fixed iron core 6 and the plunger 5.

The main point of contact is composed of a pair of fixed contacts 11 connected to a power supply line of the starter motor via two connecting terminals 9, 10, and a movable contact 12 that conducts and cuts off between the pair of fixed contacts 11.

Each of the two connecting terminals 9, 10 has a bolt-like shape to which a male screw portion is formed on an outer periphery thereof, and is fixed to a contact cover 13 made of resin through washers 14, 15.

A battery cable is connected to one of the connecting terminals 9 protruding axially from the contact cover 13, and a motor lead is connected to the other one of the connecting terminals 10.

Hereinafter, one of the connecting terminals 9 is referred to as a B terminal bolt 9, and the other one of the connecting terminals 10 is referred to as an M terminal bolt 10.

The other end side in the axial direction of the contact cover 13 is inserted into the inside of the frame 2, and is fixed by crimping to an open end of the frame 2 to form a contact chamber 16 to dispose the main point of contact therein.

The pair of fixed contacts 11 is composed of a first fixed contact 11*a* and a second fixed contact 11*b*.

The first fixed contact 11*a* is disposed in one side (upper side in FIG. 5) in a radial direction that intersects perpendicular to the axial direction of the solenoid SL, and is fixed to a pedestal 9*a* of the B terminal bolt 9.

In addition, the second fixed contact 11*b* is disposed in another side in the radial direction, and is fixed to a pedestal 10*a* of the M terminal bolt 10.

The movable contact 12 is supported via a resin washer 18, which is an insulating material, to an end of a plunger rod 17 that is fixed to the plunger 5.

Further, the movable contact 12 is urged toward a distal end of the plunger rod 17 (to the right in FIG. 5) by a contact pressure spring 19 disposed on an outer periphery of the plunger rod 17.

A stopper washer 20 is fixed to the distal end of the plunger rod 17 by crimping for preventing the movable contact 12 from detaching.

The main point of contact becomes an ON condition by the movable contact 12 abutting the pair of fixed contact points 11 by turning on the solenoid SL to electrically connect between both fixed contacts 11.

Further, the main point of contact becomes an OFF condition by the movable contact 12 separating from the pair of fixed contacts 11 by turning off the solenoid SL to electrically disconnect between the both fixed contacts 11.

Next, features of the fixed contact 11 and the movable contact 12 according to the present disclosure will be described.

Figure 1:
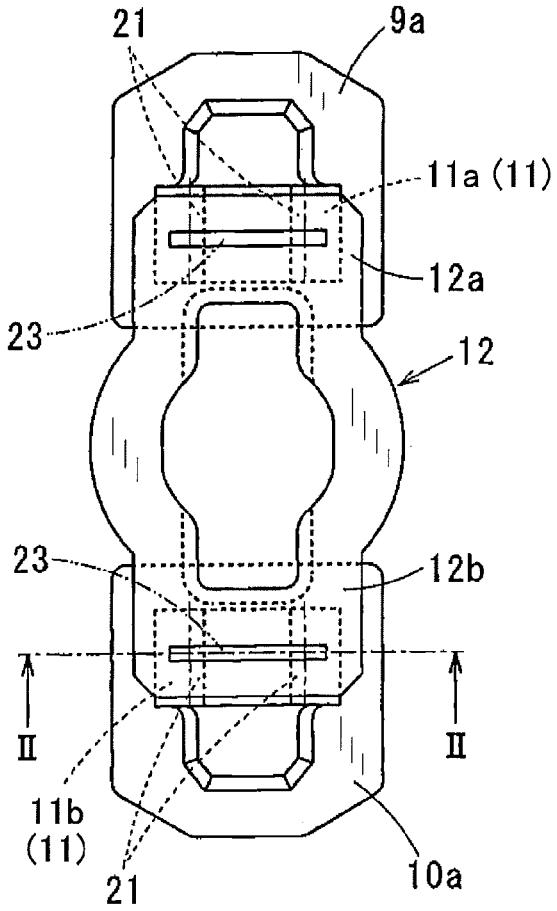
FIG. 1 shows a plan view of a pair of fixed contacts and a movable contact in an axial direction according to a first embodiment.

As shown in FIG. 1, the fixed contact 11, a planar shape of a contacting surface that faces the movable contact 12 is formed in a rectangular shape, and two protrusions 21 are formed on the contacting surface.

Here, when the radial direction where the first fixed contact 11*a* and the second fixed contact 11*b* are disposed and intersects perpendicular to the axial direction of the solenoid SL (vertical direction in FIG. 1) is referred to as a specific direction, the first fixed contact 11*a* and the second fixed contact 11*b* are disposed so that respective longitudinal direction in the rectangular shape intersects perpendicular to the specific direction, while respective lateral direction becomes parallel to the specific direction.

Figure 3B:
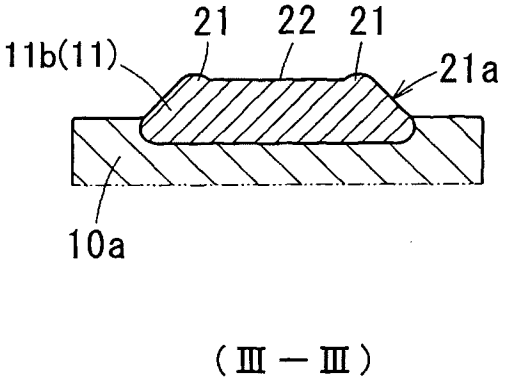
FIG. 3B shows a sectional view taken along the line III-III of FIG. 3A.
Figure 3A:
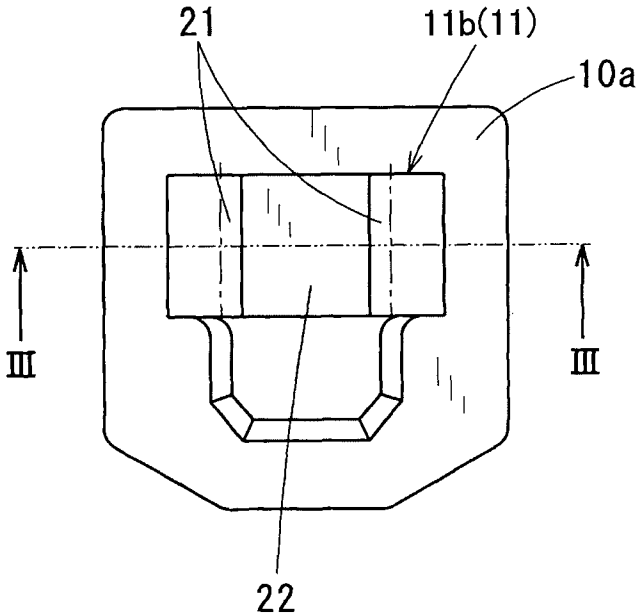
FIG. 3A shows a plan view of the fixed contact according to the first embodiment.

As shown in FIG. 3A, one each of the protrusion 21 is disposed in one end side (left side in FIG. 3A) and another end side (right side in FIG. 3A) from a center in the longitudinal direction of the fixed contact 11, and respective apexes of the protrusions 21 extend in the lateral direction of the fixed contact 11.

The apex of the protrusion 21 is, for example, formed in a sectional shape cut in the longitudinal direction of the fixed contact 11 with a convex surface having a curvature.

Further, when defining a side where two protrusions 21 face in the longitudinal direction of the fixed contact 11 as an inside, and a side opposite to the inside as an outside, an inclined surface 21*a* that inclines from the apex of the protrusion 21 to the outside is formed.

Specifically, as shown in FIG. 3B, the inclined surface 21*a* is formed inclining to a tangential direction from an end point of the curvature that forms the convex surface of the apex, and extends toward the pedestal 9*a*, 10*a* of the terminal bolt 9, 10 where the fixed contact 11 is fixed.

An angle of the inclined surface 21*a* relative to the pedestal 9*a*, 10*a* is, for example, 45 degrees.

Incidentally, a shallow recess for positioning the fixed contact 11 is formed on the pedestal 9*a*, 10*a* of the terminal bolt 9, 10.

The fixed contact 11 is positioned by fitting the counter-protrusion side thereof into the recess formed on the pedestal 9*a*, 10*a*, and is fixed to the pedestal 9*a*, 10*a* by means of brazing or the like.

Furthermore, a planar portion 22 recessed relative to the apex of the protrusion 21 is formed between the two protrusions 21 disposed in the longitudinal direction with a predetermined interval on the contacting surface of the fixed contacts 11.

Although a height of the apex of the protrusion 21 from the planar portion 22 is about fractions of a millimeter (e.g., 0.32 mm), the height of the apex may be determined appropriately by a balance between the height of the apex and a contact life due to wear of the protrusion 21.

As shown in FIG. 1, the movable contact 12 has a first contacting surface 12*a* facing the first fixed contact 11*a*, and a second contacting surface 12*b* facing the second fixed contact 11*b*.

Figure 4A:
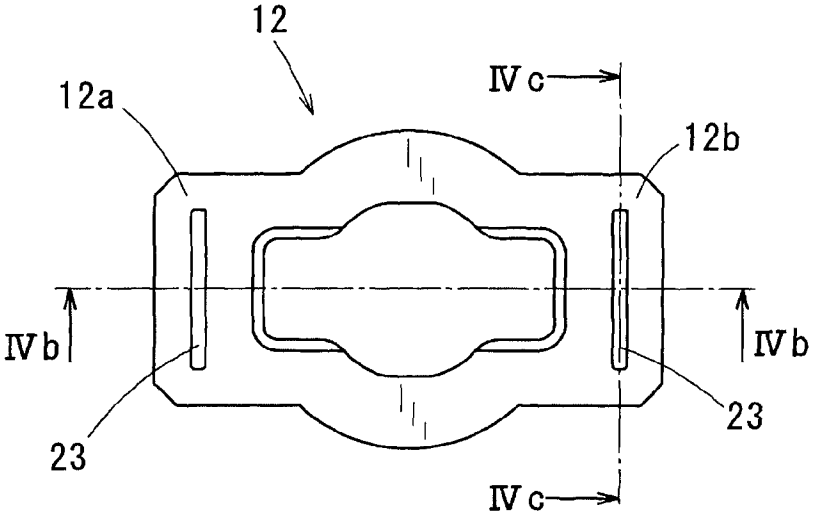
FIG. 4A shows a plan view of the movable contact according to the first embodiment.

As shown in FIG. 4A, a single projection 23 is respectively provided on the first contacting surface 12*a* and the second contacting surface 12*b* of the movable contact 12.

Figure 4B:
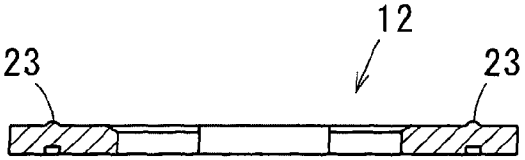
FIG. 4B shows a sectional view taken along the line IVb-IVb of FIG. 4A.
Figure 4C:
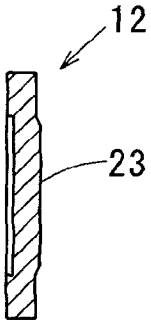
FIG. 4C shows a sectional view taken along the line IVc-IVc of FIG. 4A.

The projections 23, as shown in FIGS. 4B and 4C, for example, are formed by embossing, and are disposed so as to intersect linearly perpendicular to the two protrusions 21 formed on the fixed contact 11.

That is, as shown in FIG. 1, the projection 23 disposed on the first contacting surface 12*a* intersects linearly to the two protrusions 21 dispose on the first fixed contact 11*a*, and the projection 23 disposed on the contacting surface 12*b* is intersects linearly to the two protrusions 21 disposed on the second fixed contact 11*b*.

It is obvious that the length of the projection 23 is longer than the distance between the apexes of the two protrusions 21 disposed on the fixed contact 11.

In addition, the movable contact 12 shown in FIG. 1 is a plan view seen from an opposite side of the contacting surface, and the recesses formed by embossing the projection 23 are shown in solid lines.

Functions and Effects of the First Embodiment

1) When the outside air temperature becomes below freezing point in harsh cold climates, for example, water vapor in the air inside the contact chamber 16 is condensed on the surface of the fixed contact 11 (especially, the first fixed contact 11*a* fixed to the B terminal bolt 9) and may be frozen in the electromagnetic switch 1 mounted on the starter.

In contrast, in the first embodiment, the protrusions 21 are disposed on the fixed contacts 11, and the projection 23 facing the fixed contacts 11 are disposed on the movable contact 12.

Thus, when the movable contact 12 abuts the pair of fixed contacts 11 by the ON operation of the solenoid SL, the protrusions 21 disposed on the fixed contacts 11 and the projections 23 disposed on the movable contact 12 come to contact with each other at intersections.

Figure 2:
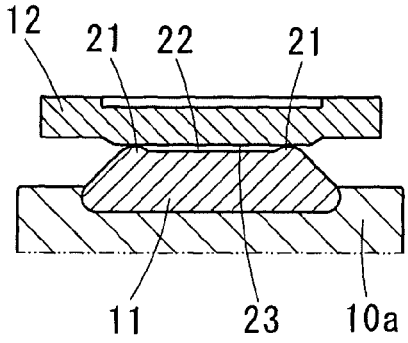
FIG. 2 shows a sectional view when the contacts are abutting according to the first embodiment (a sectional view taken along the line II-II of FIG. 1)

In other words, since the movable contact 12 does not contact to the fixed contacts 11 in surface-to-surface contact, but only intersections of each other contact as shown in FIG. 2, contacting areas between the movable contact 12 and the fixed contacts 11 will be reduced.

As a result, since contacting surface pressure between the protrusions 21 and the projections 23 increases so that the force to crush the ice frozen on the surface of the fixed contact 11 also increases, it is possible to secure conduction during the time the points of contact are abutting.

2) Since the fixed contact 11 forms the planar portion 22 recessed relative to the apex of the protrusion 21 is formed between the two protrusions 21, it is possible to collect the water that has condensed on the contacting surface of the planar portion 22.

Thereby, even if moisture collected in the planar portion 22 freezes, the apexes of the protrusions 21 can be prevented from freezing.

In other words, as long as the apexes of the protrusions 21 are exposed from the surface of the ice frozen on the plane portion 22, it is possible to secure the conduction during the point of contact is abutting.

3) By forming the planar portion 22 between the two protrusions 21, the surface area where ice adheres can be reduced as compared to the configuration that forms a plurality of grooves on the contacting surface disclosed in Japanese Utility Model Publication No. 54-88563.

Thereby, since it is possible to reduce the force with which the ice adheres on the surface of the fixed contact 11, it becomes easy to eliminate crushed ice from the contacts.

4) Since the protrusion 21 disposed on the fixed contact 11 has the inclined surface 21*a* from the apex to the outside, the moisture condensed on the surface of the fixed contact 11 will not remain on the apex of the protrusion 21, and it becomes easy for it to flow to the outside of the protrusion 21 along the inclined surface 21*a*.

In particular, in the first embodiment, since the inclined surface 21*a* extends towards the pedestal 9*a*, 10*a* of the terminal bolt 9, 10 from the apex of the protrusion 21, the moisture condensed on the surface of the protrusion 21 can flow to the surface of the pedestal 9*a*, 10*a*.

For this reason, opportunities for condensed water to collect on the surface of the fixed contact 11 become fewer, and as a result, the contacting surface can be suppressed from freezing.

Hereinafter, other embodiments of the present disclosure will be described.

It should be appreciated that, in the second embodiment and the subsequent embodiments, components identical with or similar to those in the first embodiment are given the same reference numerals, and structures and features thereof will not be described in order to avoid redundant explanation.

Second Embodiment

Although an example of forming the apex of the protrusion 21 disposed on the fixed contact 11 by the convex surface has been described in the first embodiment, the curvature of the convex surface may be changed accordingly.

Figure 6A:
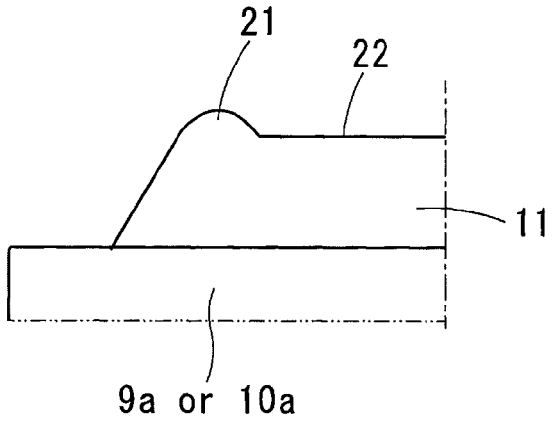
FIGS. 6A, 6B and 6C show sectional views of protrusions of the fixed contacts according to a second embodiment.
Figure 6B:
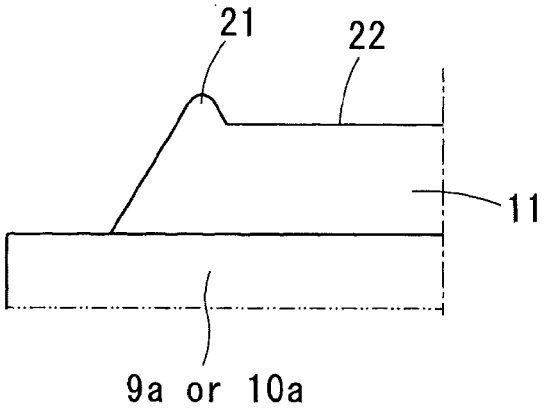

For example, FIG. 6A shows an example of a relatively small curvature, that is, the apex is formed with a large R (radius), while FIG. 6B shows an example of a relatively large curvature, that is, the apex is formed with a small R.

Figure 6C:
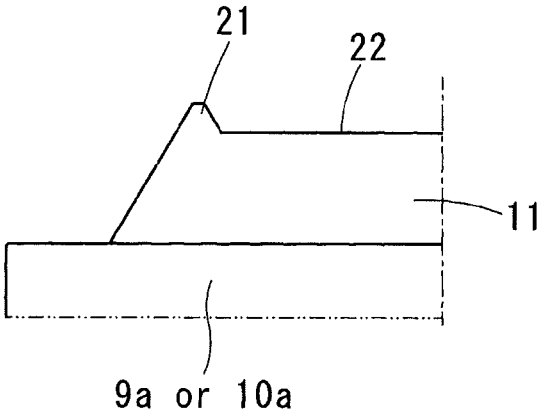

Alternatively, the apex may not have the convex surface having a curvature, but may have a shape with a small end surface on the apex of the protrusion 21 as shown in FIG. 6C.

Third Embodiment

Figure 7:
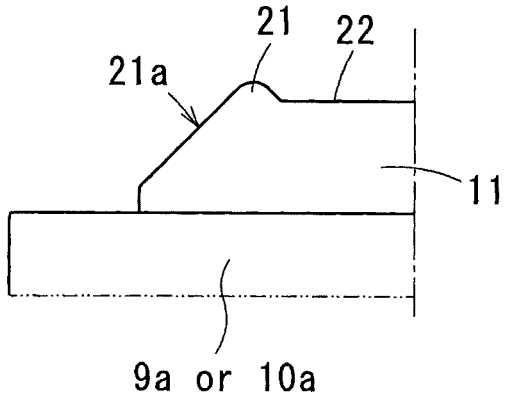
FIG. 7 shows a sectional view of a protrusion of the fixed contact according to a third embodiment.
Figure 8A:
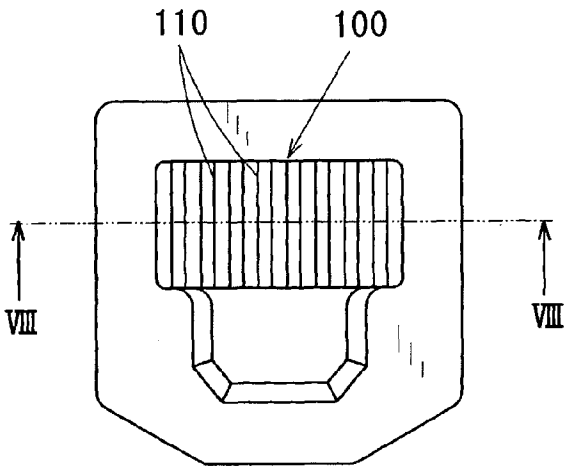
FIG. 8A shows a plan view of a fixed contact according to a conventional technology.
Figure 8B:
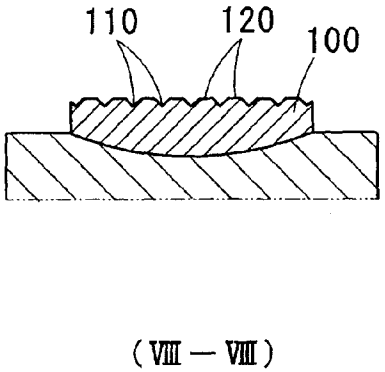
FIG. 8B shows a sectional view taken along the line VIII-VIII of FIG. 8A.

In the third embodiment, as shown in FIG. 7, the protrusion 21 disposed on the fixed contact 11 has the inclined surface 21*a* from the apex to the outside, and an end of the inclined surface 21*a* is set to be before the pedestal 9*a*, 10*a* of the terminal bolt 9 and 10.

In other words, it is an example where the end of the inclined surface 21*a* does not extend to the pedestal 9*a*, 10*a* of the terminal bolt 9, 10.

However, it is desirable that the end of the inclined surface 21*a* is as close to the surface of the pedestal 9*a*, 10*a* as possible.

Even in the configuration of the third embodiment, the moisture condensed on the surface of the fixed contact 11 will not remain on the apex of the protrusion 21, and it becomes easy for it to flow to the outside of the protrusion 21 along the inclined surface 21*a*, thus the contacting surface can be suppressed from freezing.

Modification

Although the angle of the inclined surface 21*a* formed from the apex of the protrusion 21 to the outside relative to the surface of the pedestal 9*a*, 10*a* disposed at the terminal bolt 9, 10 is disclosed to be 45 degrees in the first embodiment, it is not limited to 45 degrees, and the angle may be smaller or greater than 45 degrees.

That is, it is possible to alter the angle of the inclined surface 21*a* appropriately according to a mounting position of the starter.

What is claimed is:

1. An electromagnetic switch comprising:

a solenoid that forms an electromagnet by energization to a coil;

a pair of fixed contacts respectively connected to a power supply side and a load side of an electrical circuit via two connecting terminals; and a movable contact that conducts and cuts off between the pair of fixed contacts in response to respective ON/OFF operation of the solenoid; wherein, the pair of fixed contacts has a first fixed contact disposed in one side in a radial direction that intersects perpendicular to an axial direction of the solenoid and a second fixed contact disposed in another side in the radial direction;

when a direction which intersects perpendicular to the radial direction on a plane of the fixed contact is referred to as a longitudinal direction and another direction which intersects perpendicular to the longitudinal direction is referred to as a lateral direction, the fixed contact has two protrusions extending in the lateral direction on a contacting surface that faces the movable contact;

the two protrusions are disposed in the longitudinal direction with a predetermined interval therebetween, and a planar portion recessed relative to apexes of the protrusions is formed between the two protrusions;

the movable contact has a first contacting surface facing the first fixed contact and a second contacting surface facing the second fixed contact;

a single projection that intersects perpendicular to the two protrusions disposed on the first fixed contact is disposed on the first contacting surface; and another single projection that intersects perpendicular to the two protrusions disposed on the second fixed contact is disposed on the second contacting surface.

2. The electromagnetic switch according to claim 1, wherein, when defining a side where two protrusions face in the longitudinal direction of the fixed contact with the planar portion therebetween as an inside, and a side opposite to the inside as an outside, an inclined surface that inclines from the apex of the protrusion toward the outside is formed to the fixed contact.

3. The electromagnetic switch according to claim 2, wherein, the fixed contact is fixed to a pedestal disposed in the connecting terminals, and the inclined surface is formed extending from the apex toward the pedestal.

* * * * *